US012781482B2

(12) United States Patent
Qian

(10) Patent No.: US 12,781,482 B2
(45) Date of Patent: Nov. 3, 2026

(54) INTERNALLY CONNECTED SINGLE-FLOW FAUCET BODY

(71) Applicant: Shihui Qian, Wenzhou (CN)

(72) Inventor: Shihui Qian, Wenzhou (CN)

( * ) Notice: Subject to any disclaimer, the term of this patent is extended or adjusted under 35 U.S.C. 154(b) by 90 days.

(21) Appl. No.: 18/977,702

(22) Filed: Dec. 11, 2024

(65) Prior Publication Data

US 2026/0132606 A1 May 14, 2026

(30) Foreign Application Priority Data

Nov. 8, 2024 (CN) ..... 202422733703.7

(51) Int. Cl.
*E03C 1/04* (2006.01)

(52) U.S. Cl.
CPC ..... *E03C 1/0403* (2013.01)

(58) Field of Classification Search
CPC ..... E03C 1/0403
See application file for complete search history.

(56) References Cited

U.S. PATENT DOCUMENTS 12,442,459 B2 * 10/2025 Qiu
2022/0178119 A1 * 6/2022 Tzeng

* cited by examiner

*Primary Examiner* — Janie M Loeppke
(74) *Attorney, Agent, or Firm* — Sandy Lipkin

(57) ABSTRACT

The present invention provides an internally connected single-flow faucet body, including a body sleeve, one end of the body sleeve being provided with a first connection internal thread; and further including a support baffle fastened to an inner wall of the body sleeve by welding, where a side of the support baffle facing away from the first connection internal thread is welded with a first water connection port coaxially arranged with a center of the support baffle and a water guide pipe offset from the center of the support baffle. The present invention has advantages of compact structure, high strength, and low production costs.

10 Claims, 4 Drawing Sheets

INTERNALLY CONNECTED SINGLE-FLOW FAUCET BODY

REFERENCE TO PRIOR APPLICATION

This application claims priority to Chinese Patent Application 202422733703.7, filed on Nov. 8, 2024, which is incorporated herein by reference.

TECHNICAL FIELD

The present invention relates to the field of faucet accessories, and specifically, to an internally connected single-flow faucet body.

BACKGROUND

Existing single-flow faucet bodies typically feature a valve core installed with either a bottom inlet and side outlet or a side inlet and bottom outlet water flow configuration. This requires transferring the water pathway from the side to the bottom to achieve a bottom inlet and bottom outlet. To ensure a proper water flow rate and reasonable layout, currently injection molding is commonly used in production. However, this approach brings about problems such as poor pressure resistance of plastic components, low overall strength, and susceptibility to breakage. Increasing wall thickness raises material costs, and there are also shrinkage concerns.

SUMMARY

Based on the foregoing problems, the present invention aims to provide an internally connected single-flow faucet body with a compact structure, high strength, and low production costs.

For the foregoing problems, the following technical solution is provided: an internally connected single-flow faucet body, including a body sleeve, one end of the body sleeve being provided with a first connection internal thread; and further including a support baffle fastened to an inner wall of the body sleeve by welding, where a side of the support baffle facing away from the first connection internal thread is welded with a first water connection port coaxially arranged with a center of the support baffle and a water guide pipe offset from the center of the support baffle, the first water connection port and the water guide pipe are in communication with a cavity of the body sleeve on a side of the support baffle facing the first connection internal thread, and an end of the water guide pipe away from the support baffle extends out of the body sleeve and is welded with a second water connection port.

In the foregoing structure, the body sleeve is made by cutting a pipe material, so its length can be easily controlled by adjusting the cutting length according to actual needs. The first connection internal thread is used to install a valve core. A lower end of the valve core abutting against the support baffle forms a barrier for the first water connection port on the side of the support baffle facing the first connection internal thread and the water guide pipe, to control the on/off of the waterway. The support baffle is welded to the body sleeve to ensure connection strength, sealing, and reliability. Because the first water connection port corresponds to a water port at the center of the bottom of the valve core, and a water port on the sidewall of the valve core needs to guide the waterway to the position of the support baffle, the water guide pipe is arranged to be offset.

The present invention is further provided as follows: An outer edge of the support baffle is provided with a reinforced edge formed by stamping and stretching, and the reinforced edge is fastened to the inner wall of the body sleeve by welding.

In the foregoing structure, the reinforced edge not only improves strength of the support baffle, but also increases reliability when welded to the inner wall of the body sleeve.

The present invention is further provided as follows: A second connection internal thread is provided at the first water connection port.

The present invention is further provided as follows: The second water connection port is a quick-connect water port.

In the foregoing structure, both the first water connection port and the second water connection port are used to connect to water inlet and outlet pipes.

The present invention is further provided as follows: A cross-section of the water guide pipe when located within the cavity of the body sleeve is spindle-shaped, elliptical, or waist-shaped, with its minor axis pointing toward the center of the support baffle.

In the foregoing structure, limited by the inner diameter of the body sleeve, on the premise that the water inlet and outlet flow rate is ensured, if the cross-section of the water guide pipe when located within the cavity of the body sleeve is circular, interference is caused to the first water connection port. Therefore, the cross-section is set to be spindle-shaped, elliptical, or waist-shaped, making room for the first water connection port while ensuring the flow rate.

The present invention is further provided as follows: The cross-section of the water guide pipe restores to a circular shape after passing through the cavity of the body sleeve and is connected to the second water connection port.

In the foregoing structure, good interconnection transition between the water guide pipe and the second water connection port is ensured.

The present invention is further provided as follows: The side of the support baffle facing the first connection internal thread forms an annular sealing region between an outer side of the first water connection port and the water guide pipe.

In the foregoing structure, the annular sealing region is used to fit against a seal ring at the lower end of the valve core, preventing water leakage between the first water connection port and the water guide pipe.

The present invention is further provided as follows: The internally connected single-flow faucet body further includes a thread ring fastened at an end portion of the body sleeve by welding, where the first connection internal thread is located on an inner surface of the thread ring.

In the foregoing structure, the thread ring is connected to the body sleeve by welding, eliminating the need for additional wall thickness materials required when machining the first connection internal thread, thus ensuring that the wall thickness of the body sleeve is kept as thin as possible when selecting materials.

The present invention is further provided as follows: The body sleeve, the support baffle, the first water connection port, the water guide pipe, the second water connection port, and the thread ring are all made from stainless steel materials.

In the foregoing structure, both corrosion resistance and strength are ensured.

The present invention is further provided as follows: An outer wall of the body sleeve is provided with installation threads.

In the foregoing structure, the installation threads fit with a nut to install the body sleeve.

Beneficial effects of the present invention are as follows: The overall structure is simple, with flexible machining, light weight, and low material waste, ensuring both strength and pressure resistance, while effectively increasing the service life.

Figure 1:
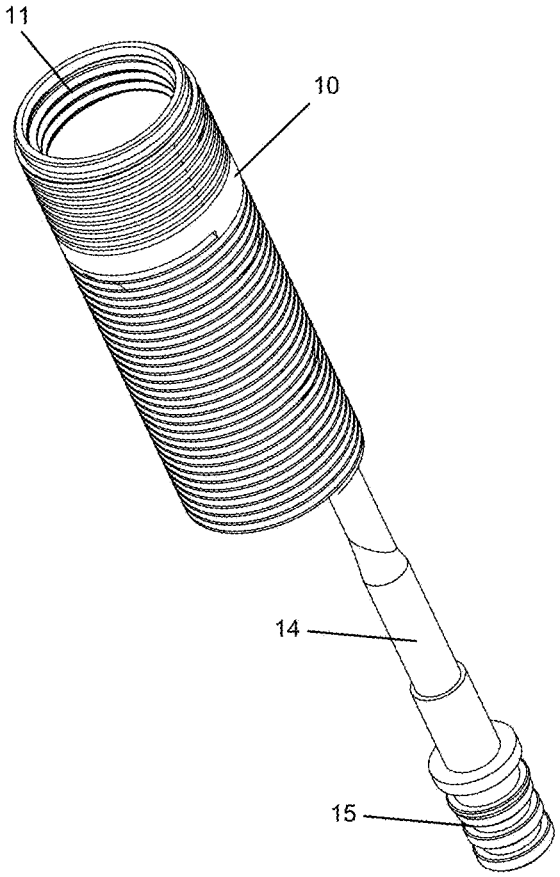
FIG. 1 is a schematic diagram of a three-dimensional structure according to the present invention.

Meanings of the reference numerals in the figures: 10—Body sleeve; 101—Installation threads; 11—First connection internal thread; 12—Support baffle; 121—Reinforced edge; 13—First water connection port; 131—Second connection internal thread; 14—Water guide pipe; 15—Second water connection port; 16—Thread ring; a—Annular sealing region.

DETAILED DESCRIPTION OF EMBODIMENTS

With reference to the accompanying drawings and embodiments, the following further describes specific implementations of the present invention in detail. The following embodiments are used to describe the present invention but are not intended to limit the scope of the present invention.

Figure 2:
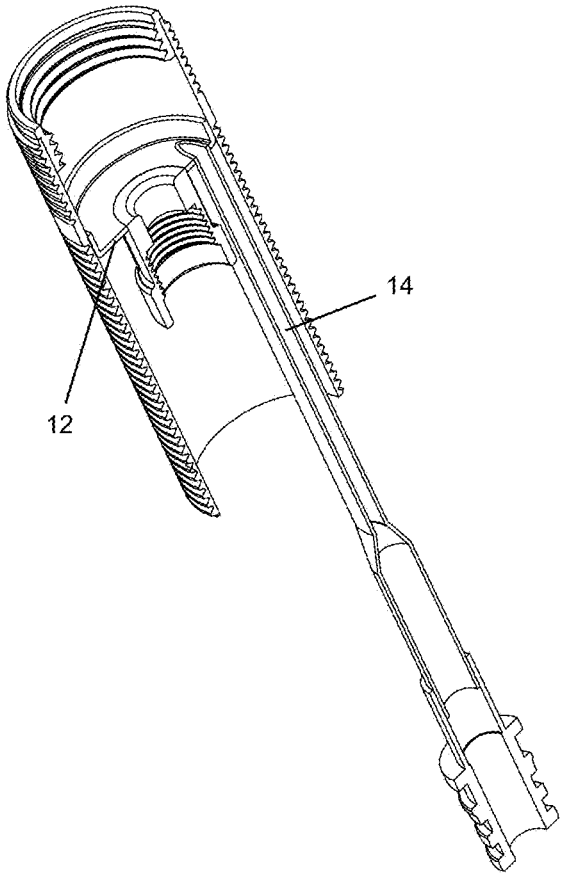
FIG. 2 is a schematic diagram of a full-sectional three-dimensional structure according to the present invention.
Figure 3:
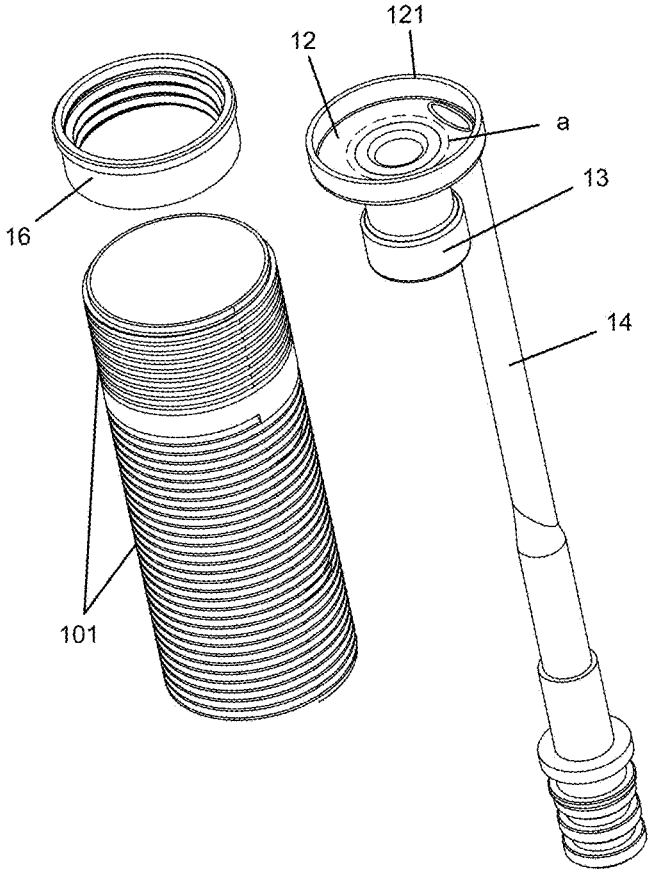
FIG. 3 is a schematic diagram of an exploded three-dimensional structure according to the present invention.
Figure 4:
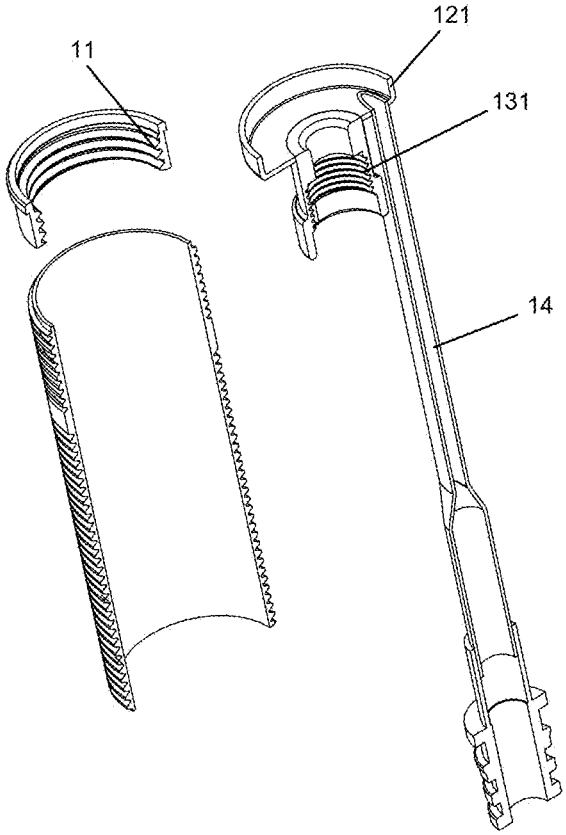
FIG. 4 is a schematic diagram of an exploded full-sectional three-dimensional structure according to the present invention.

Referring to FIG. 1 to FIG. 4, as shown in FIG. 1 to FIG. 4, an internally connected single-flow faucet body includes a body sleeve 10, one end of the body sleeve 10 being provided with a first connection internal thread 11; and further includes a support baffle 12 fastened to an inner wall of the body sleeve 10 by welding, where a side of the support baffle 12 facing away from the first connection internal thread 11 is welded with a first water connection port 13 coaxially arranged with a center of the support baffle and a water guide pipe 14 offset from the center of the support baffle, the first water connection port 13 and the water guide pipe 14 are in communication with a cavity of the body sleeve 10 on a side of the support baffle 12 facing the first connection internal thread 11, and an end of the water guide pipe 14 away from the support baffle 12 extends out of the body sleeve 10 and is welded with a second water connection port 15.

In the foregoing structure, the body sleeve 10 is made by cutting a pipe material, so its length can be easily controlled by adjusting the cutting length according to actual needs. The first connection internal thread 11 is used to install a valve core (not shown in the figure). A lower end of the valve core (not shown in the figure) abutting against the support baffle 12 forms a barrier for the first water connection port 13 on the side of the support baffle 12 facing the first connection internal thread 11 and the water guide pipe 14, to control the on/off of the waterway. The support baffle 12 is welded to the body sleeve 10 to ensure connection strength, sealing, and reliability. Because the first water connection port 13 corresponds to a water port at the center of the bottom of the valve core (not shown in the figure), and a water port on the sidewall of the valve core (not shown in the figure) needs to guide the waterway to the position of the support baffle 12, the water guide pipe 14 is arranged to be offset.

In this embodiment, an outer edge of the support baffle 12 is provided with a reinforced edge 121 formed by stamping and stretching, and the reinforced edge 121 is fastened to the inner wall of the body sleeve 10 by welding.

In the foregoing structure, the reinforced edge 121 not only improves strength of the support baffle 12, but also increases reliability when welded to the inner wall of the body sleeve 10.

In this embodiment, a second connection internal thread 131 is provided at the first water connection port 13.

In this embodiment, the second water connection port 15 is a quick-connect water port.

In the foregoing structure, both the first water connection port 13 and the second water connection port 15 are used to connect to water inlet and outlet pipes.

In this embodiment, a cross-section of the water guide pipe 14 when located within the cavity of the body sleeve 10 is spindle-shaped, elliptical, or waist-shaped, with its minor axis pointing toward the center of the support baffle 12.

In the foregoing structure, limited by the inner diameter of the body sleeve 10, on the premise that the water inlet and outlet flow rate is ensured, if the cross-section of the water guide pipe 14 when located within the cavity of the body sleeve 10 is circular, interference is caused to the first water connection port 13. Therefore, the cross-section is set to be spindle-shaped, elliptical, or waist-shaped, making room for the first water connection port 13 while ensuring the flow rate.

In this embodiment, the cross-section of the water guide pipe 14 restores to a circular shape after passing through the cavity of the body sleeve 10 and is connected to the second water connection port 15.

In the foregoing structure, good interconnection transition between the water guide pipe 14 and the second water connection port 15 is ensured.

In this embodiment, the side of the support baffle 12 facing the first connection internal thread 11 forms an annular sealing region a between an outer side of the first water connection port 13 and the water guide pipe 14.

In the foregoing structure, the annular sealing region a is used to fit against a seal ring (not shown in the figure) at the lower end of the valve core (not shown in the figure), preventing water leakage between the first water connection port 13 and the water guide pipe 14.

In this embodiment, the internally connected single-flow faucet body further includes a thread ring 16 fastened at an end portion of the body sleeve 10 by welding, where the first connection internal thread 11 is located on an inner surface of the thread ring 16.

In the foregoing structure, the thread ring 16 is connected to the body sleeve 10 by welding, eliminating the need for additional wall thickness materials required when machining the first connection internal thread 11, thus ensuring that the wall thickness of the body sleeve 10 is kept as thin as possible when selecting materials.

In this embodiment, the body sleeve 10, the support baffle 12, the first water connection port 13, the water guide pipe 14, the second water connection port 15, and the thread ring 16 are all made from stainless steel materials.

In the foregoing structure, both corrosion resistance and strength are ensured.

In this embodiment, an outer wall of the body sleeve 10 is provided with installation threads 101.

In the foregoing structure, the installation threads 101 fit with a nut (not shown in the figure) to install the body sleeve 10.

Beneficial effects of the present invention are as follows: The overall structure is simple, with light weight and low material waste, ensuring both strength and pressure resistance, while effectively increasing the service life.

The foregoing description is merely a preferred implementation of the present invention. It should be noted that a person of ordinary skill in the art may make some improvements and variations without departing from the technical principles of the present invention. These assumed improvements and variations are also considered being within the protection scope of the present invention.

What is claimed is:

1. An internally connected single-flow faucet body, comprising a body sleeve, one end of the body sleeve being provided with a first connection internal thread; and further comprising a support baffle fastened to an inner wall of the body sleeve by welding, wherein a side of the support baffle facing away from the first connection internal thread is welded with a first water connection port coaxially arranged with a center of the support baffle and a water guide pipe offset from the center of the support baffle, the first water connection port and the water guide pipe are in communication with a cavity of the body sleeve on a side of the support baffle facing the first connection internal thread, and an end of the water guide pipe away from the support baffle extends out of the body sleeve and is welded with a second water connection port.

2. The internally connected single-flow faucet body according to claim 1, wherein an outer edge of the support baffle is provided with a reinforced edge formed by stamping and stretching, and the reinforced edge is fastened to the inner wall of the body sleeve by welding.

3. The internally connected single-flow faucet body according to claim 1, wherein a second connection internal thread is provided at the first water connection port.

4. The internally connected single-flow faucet body according to claim 1, wherein the second water connection port is a quick-connect water port.

5. The internally connected single-flow faucet body according to claim 1, wherein a cross-section of the water guide pipe when located within the cavity of the body sleeve is spindle-shaped, elliptical, or waist-shaped, with its minor axis pointing toward the center of the support baffle.

6. The internally connected single-flow faucet body according to claim 5, wherein the cross-section of the water guide pipe restores to a circular shape after passing through the cavity of the body sleeve and is connected to the second water connection port.

7. The internally connected single-flow faucet body according to claim 1 or 5 or 6, wherein the side of the support baffle facing the first connection internal thread forms an annular sealing region between an outer side of the first water connection port and the water guide pipe.

8. The internally connected single-flow faucet body according to claim 1, further comprising a thread ring fastened at an end portion of the body sleeve by welding, wherein the first connection internal thread is located on an inner surface of the thread ring.

9. The internally connected single-flow faucet body according to claim 8, wherein the body sleeve, the support baffle, the first water connection port, the water guide pipe, the second water connection port, and the thread ring are all made from stainless steel materials.

10. The internally connected single-flow faucet body according to claim 1, wherein an outer wall of the body sleeve is provided with installation threads.

* * * * *